United States Patent [19]

Feiler

[11] 4,164,910

[45] Aug. 21, 1979

[54] SCORE REGISTERING DEVICE

[76] Inventor: Robert Feiler, 2 Oriole Pl., Port Chester, N.Y. 10573

[21] Appl. No.: 785,316

[22] Filed: Apr. 7, 1977

[51] Int. Cl.[2] ..... A63B 71/06

[52] U.S. Cl. ..... 116/225; 2/170; 40/586; 273/DIG. 26

[58] Field of Search ..... 116/120; 40/129 A; 2/170; 273/DIG. 17, DIG. 18, DIG. 30

[56] References Cited

U.S. PATENT DOCUMENTS

| | | | |
|---|---|---|---|
| 402,700 | 5/1889 | Van Zile | 116/120 |
| 2,127,926 | 8/1938 | Mason | 2/170 |
| 2,257,518 | 9/1941 | Tice | 116/120 |
| 3,316,669 | 5/1967 | Nachbar | 40/142 R |
| 3,327,419 | 6/1967 | Stanos | 40/140 X |
| 3,635,190 | 1/1972 | Araki | 16/120 |
| 3,712,623 | 1/1973 | Donnald | 2/170 X |
| 3,847,110 | 11/1974 | Inoue | 116/120 |
| 3,895,797 | 7/1975 | Moore | 273/DIG. 30 |
| 3,936,963 | 2/1976 | Chan | 116/120 X |
| 4,009,679 | 3/1977 | Kircher | 116/120 |
| 4,040,632 | 8/1977 | Pawl | 273/DIG. 30 |
| 4,061,256 | 12/1977 | Beer et al. | 2/170 X |

FOREIGN PATENT DOCUMENTS

| | | | |
|---|---|---|---|
| 344567 | 3/1931 | United Kingdom | 116/120 |
| 1236852 | 6/1971 | United Kingdom | 116/120 |

*Primary Examiner*—Daniel M. Yasich

[57] ABSTRACT

A device for registering the score or points in a game or contest comprising a scoreboard member bearing indicia of all possible score points, score indicator markers and means for detachably fastening the score indicator markers to the scoreboard member in association with the individual indicia of the score points and athletic apparel comprising such score registering device.

4 Claims, 6 Drawing Figures

SCORE REGISTERING DEVICE

BACKGROUND OF THE INVENTION

1. Field of the Invention

This invention relates to a device for registering the score or points in a game or contest.

More particularly the invention relates to a device for registering the score or points in a game or contest having a limited number of possible scores or points.

The invention further relates to an item of apparel comprising a device for registering the score or points of a game or contest.

2. Description of the Prior Art

In tennis and similar sports such as badminton and deck tennis the contest is won by the player who first attains the number of points which has been designated the winning score. Likewise, in baseball a predetermined number of balls, strikes and outs constitutes a walk, an out and an inning, repectively. Similarly, in a sport such as golf or a game like ice hockey, while there is theoretically no limit to the possible number of points for the stokes on a hole or goals in a game, repectively, in actuality, in the play of these games by any reasonably competent contestants, there is a realistic limit to such scores.

In order to register the points or scores attained in the play of such games various devices have been suggested, including those which can be worn or carried by the contestant.

Typical devices are exemplified by U.S. Pat. Nos. 1,755,995; 3,122,851; 2,264,797; 2,405,690 and 3,777,699. These prior devices commonly utilize some type of dial mechanism mounted in a watch-type case and adapted for attachment to a wrist watch type wrist band.

While generally satisfactory for registering the game score these devices have serious drawbacks. In use, the device, mounted on a wrist watch type wrist band is strapped around the player's wrist. As such, the device will be subject to shocks and blows transmitted each time the player executes a hit as with a tennis racket, golf club, baseball bat, hockey stick or the like, being held in the hands. As a result the dials must require string and forceful manipulation to accomplish a score change or risk the accidental shifting of the dials by the shock of the repeated collision of the playing instrument and the projectile of the game.

In addition, the mechanical components of the prior art devices are also subject to the corrosive effects of perspiration generated during play which can ultimately result in the malfunctioning of the device.

Since these devices are made of rigid material there exists the possibility that they may be the cause of injury to the contestant during the play of a game.

SUMMARY OF THE INVENTION

In accordance with this invention there is provided a device for registering the score or points in a game or contest comprising a scoreboard member bearing indicia of all possible score points, score indicator markers and means for detachably fastening the score indicator markers to the scoreboard member in association with the individual indicia of the score points.

In a preferred embodient of this invention the score registering device is comprised essentially of a flexible material.

In a further preferred embodient of the invention the score indicator marker is provided with means for permanently maintaining said marker in association with the scoreboard member.

In accordance with this invention there is also provided an article of apparel comprising a device for registering the score or points in a game or contest said device comprising a scoreboard member bearing indicia of all possible score points, score indicator markers and means for detachably fastening the score indicator markers to the scoreboard member in association with the individual indicia of the score points.

In a preferred embodiment of this invention the article of apparel is a sweatband to be worn on the contestant's wrist.

In a further preferred embodient of this invention the article of apparel is a shirt, skirt or pair of trousers or shorts.

The score markers are fasten to the scoreboard member by means which resist unintentional unfastening due to shocks or jarring during the play of the game. Moreover, the device is free from any operating mechanisms which might be damaged by blows, shocks and/or human perspiration to which it may be exposed during the play of the game. It is also free of any mechanisms which may cause injury to the participant during the play of a game.

BRIEF DESCRIPTION OF THE DRAWINGS

Other aspects of this invention will appear in the following detailed description and appended claims, reference being made to the accompanying drawing forming a part of the specification.

DESCRIPTION OF THE PREFERRED EMBODIEMNTS

Figure 1:
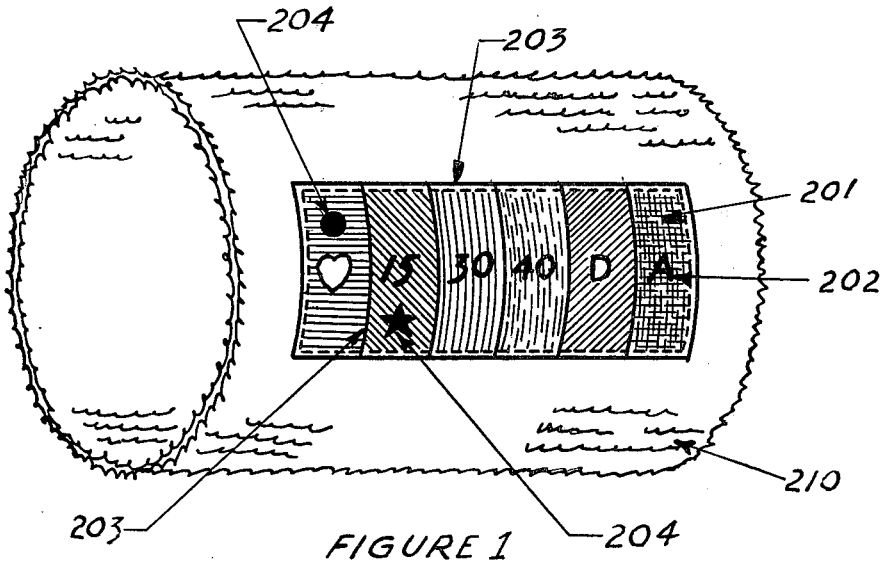
FIG. 1 is a perspective view of one embodiment of the device of this invention.

In FIG. 1 of the drawings there is illustrated an embodiment of the invention wherein the score registering device comprises a scoreboard 201 member bearing the indicia of all possible score points for the game of tennis 202. The sequence of point scoring in tennis consists of "love" which signifies zero, "15", "30", "40", "ADD", and "GAME". However, if during the play of the game the player's scores are tied at "40—40" the score is known as "Deuce" and the scoring from this score can be both additive and substractive. In order to win the game one player must score two successive points after DEUCE. The first point after a DEUCE score is known as the ADD point and a second successive point won by the player with the ADD point before his opponent scores a point over DEUCE will win the game. However, when one player has the ADD point and his opponent scores, the score is tied and returns to "40—40" which is DEUCE. If a player reaches 40 and wins the next point before his opponent reaches 40, the first player wins the game on this next point and does not have to win Two successive points after 40 as in the DEUCE situation.

The scoreband member for a device to be used to register the score points for a game of tennis is therefore provided with the indicia for "love", (zero, "15", "30", "40", "ADD", and "DUCE" in the form of symbols, numerals or letters representinng each of these scores.

Distinct areas are provided for the indicia of each score by lines of division 203 on the face of the scoreboard and differing background coloring for each of the areas. Such divisions and color markings are optional however and the indicia may be differenciatable solely by their inherent different confirguations.

The score markers 204 are of a size and shape which allows them to be detachably fastened in association with a single indicia of the scoreboard. This may be accomplished by utilizing markers which are sufficiently small so that they may be positioned wholly inside the designated ares of a sigle score indicia or utilizing markers having a physical configuration which allows orientation of the marker when fastened to the scoreboard to designate a single score indicia as by a marker 205 in the form of an arrow or pointer.

The device may be used to register the score of one or both players of the game. When the device is utilized to reister the score of more than one player, or for that matter more than one team since tennis may be played both by individuals and teams, the score indicating markers for the individual players or teams are preferably physically differentiable as by shape. Alternatively, when utilizing the device for registering the score of opposing players or teams identical score indicating markers may be used by being placed in physically distinct parts of the areas associated with the score indicia as by placing the markers in the upper area of the scoreboard for one team or player and in the lower area of the scoreboard for the opposing team or player.

The score indicator markers in the embodiment of the device illustrated in FIG. 1 are detachably fastened to the scoreboard by means of a hook and loop tape type fastener. The face of the scoreboard comprises one element of the hook and loop tape type fastener while the score indicator markers comprise the cooperating element of the hook and loop type tape fastener.

Figure 2:
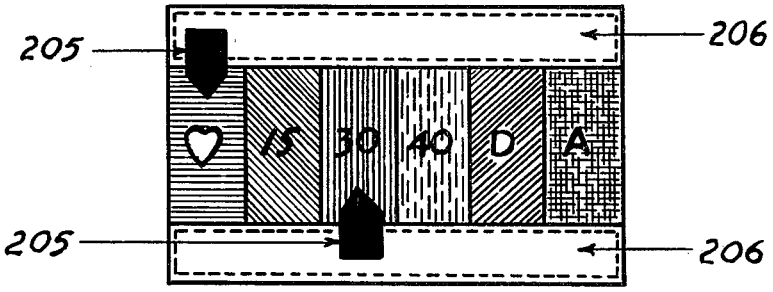
FIG. 2 is an elevation view of another embodiment of the device of this invention.

In another embodiment of the invention illustrated in FIG. 2 the means for detachably fastening the score indicator markers to the scoreboard comprises cooperating elements of a hook and loop tape type fastener wherein pieces of the first element 206 of the tape fastener are attached to the upper and lower edges of the scoreboard and the score indicator markers comprise the cooperating element of the tape fastener.

In a still further embodiment, illustrated in FIG. 3 one element of a snap fastener 207 is positioned above and below each score indicia on the scoreboard and the score indicator markers 208 are provided with the cooperating element of the snap fastener 209.

Figure 3:
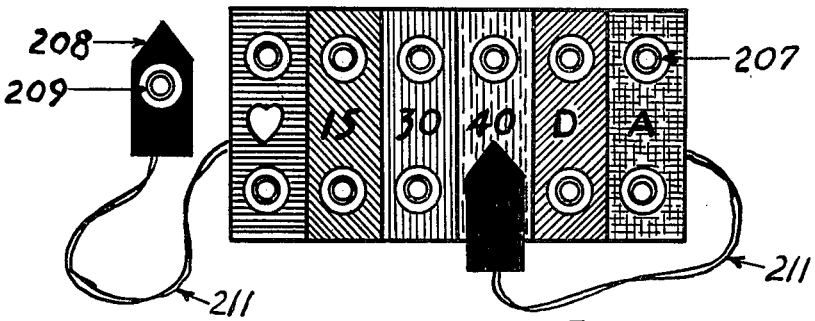
FIGS. 3, 4, 5 and 6 are still further embodiments of the device of this invention.

The score indicator markers 208 of the embodiment of FIG. 3 are further provided with strings 211 attached at one end to said markers and at the other end to the scoreboard member. The strings are sufficiently long to allow the marker to be place on all the indicia of the scoreboard member while short enough to maintain the marker in association with the scoreboard member when not actually in detachable association with any of the indicia of the scoreboard member.

Figure 4:
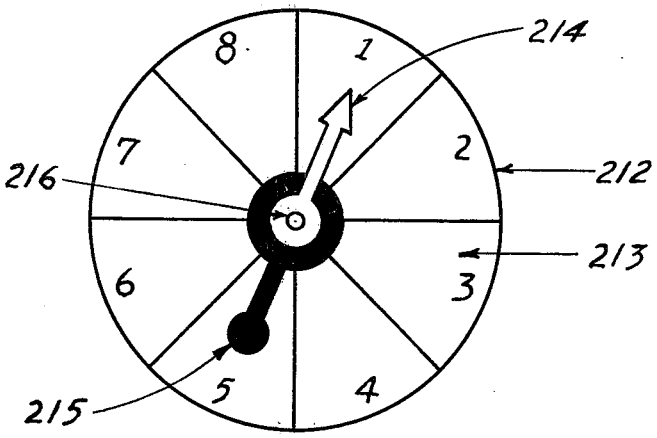

FIG. 4 illustrates a device of this invention which may be utilized to register the number of strokes on each hole of a golf game. An alternate embodiment of the scoreboard member 212 is shown utilizing a circular configuration rather that the rectangle of the previously described embodiments. In this embodiment the means for detachably fastening the score indicator markers 215, 214 is a loop and hook tape type fastener wherein the face of the scoreboard member 213 comprises one member of the hook and loop tape type fastener while the under side of the score indicator markers 214, 215 comprise the cooperating member of the hook and loop tape type fastener. In this embodiment a rivet 216 comprises the means for permanently maintaining the markers in association with the scoreboard member as well as acting as the pivot around which the marker rotates to indicate the appropriate indicia.

Figure 5:
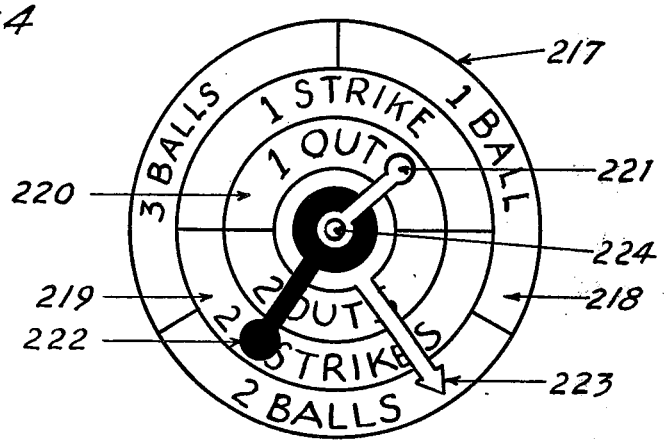

FIG. 5 illustrates a device of this invention which registers the balls, strikes and outs in a baseball game.

Figure 6:
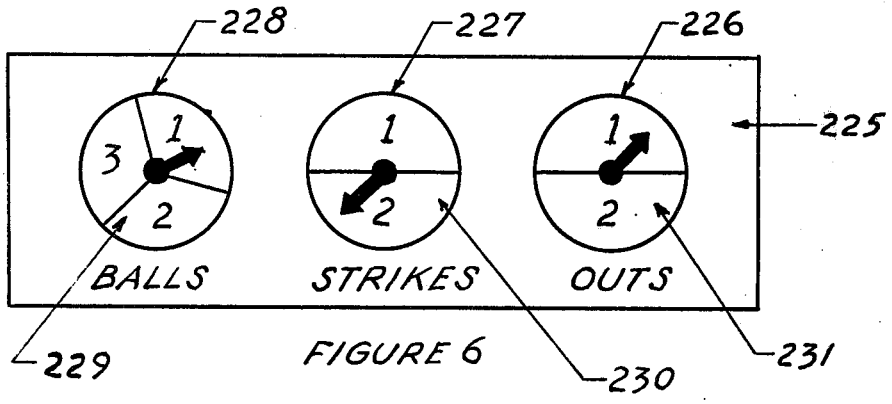

FIG. 6 illustrates a similar device using a different configuation of the scoreboard member.

In FIG. 5 the scoreboard member 217 comprises three concentric rings 218, 219, 220 bearing the indicia for ball, strikes and outs, respectively. The score indicating members, 221, 222, 223 are held in permanent association with the scoreboard member by a single rivet 224 which also serves as a pivot for their rotation to the proper score indicia. The means for detachably fasetening the score indicator means to the scoreboard member is the same as that utilized in the golf score registering device of FIG. 4.

In FIG. 6 the scoreboard member 225 comprises three individual sets of indicia 226, 227, 228 for each of the outs, strikes and balls, respectively, indicating the possible scores for each 231, 230, 229, respectively.

In any of the embodiments of the score registering device of FIGS. 4, 5, or 6 the means for detachably fastening the score indicator markers to the scoreboard member may be any of those disclosed in the embodiment of the tennis score registering device. Likewise, in any embodiment of this invention the use of any device for the fastening of two flexible members such as shaps, hooks and eyes, buttons and button holes, among others, as the means for detachably fastening the score indicator markers to the scoreboard member is to be considered within the scope of this invention.

The scoreboard member and the score indicator markers are preferably substantially constructed of flexible materials such as the tapes of the hook and loop tape fasteners or a stout material such as canvas.

A further embodiment of this invention shown in FIG. 1 is an article of apparel comprising the score registering device herein disclosed.

In the preferred embodiment of such invention the article of apparel is a sweatband 210. In other embodiments of the invention the article of apparel may be a shirt, pair of trousers or shorts, a glove, a skirt or any other article of clothing which would make the score registering device reasonably accessible to the player during the play of the game.

In use the score indicator markers are detachably fastened to the scoreboard in association with the indicia indicating the score of the game at any time or the number of stokes or balls or stikes, etc. as is appropriate to the score being registered.

It is to be understood that the foregoing detailed description is given merely by way of illustration and that many variations may be made therein without departing from the spirit and scope of the invention.

What is claimed is:

1. An article of apparel comprising a sweatband to be worn on the wrist having mounted thereon a score registering device of flexible material comprising a flexible scoreboard member bearing indicia of all possible point scores permanently attached to said sweatband;

at least one score indicator marker; means on portions of said marker for detachably fastening said marker to selected indicia on said scoreboard member in association with any of said indicia;

said means for detachably fastening said indicator markers to said scoreboard member comprising cooperating elements of a hook and loop type fastener wherein opposite edge portions of the said scoreboard member comprises one element of said hook and loop type fastener and the portions of said score indicator marker comprises the cooperating element of said hook and loop type fastener.

2. The article of apparel of claim 1 comprising a plurality of markers said markers being distinguishable by physical appearance.

3. The article of apparel of claim 1 further comprising means for permanently keeping said member maintained in association with said scoreboard member.

4. The article of apparel of claim 1 wherein said indicia are all the possible scores of a tennis match.

* * * * *